US007063021B2

(12) United States Patent
Keegstra et al.

(10) Patent No.: US 7,063,021 B2
(45) Date of Patent: Jun. 20, 2006

(54) EXPANDED VOLUME LESS LETHAL BALL TYPE PROJECTILE

(76) Inventors: Neil Keegstra, 36 Ivy Pl., Glenwood, NJ (US) 07418; Randy R. Fritz, 101 Dogtown Rd., Bloomsburg, PA (US) 17815; Robin A. Fritz, 109 Dogtown Rd., Bloomsburg, PA (US) 17815; Anthony Edward Kinchin, 12 Slaney Road, Walsall, West Midlands WS2 9AF (GB)

( * ) Notice: Subject to any disclaimer, the term of this patent is extended or adjusted under 35 U.S.C. 154(b) by 165 days.

(21) Appl. No.: 10/748,944

(22) Filed: Dec. 29, 2003

(65) Prior Publication Data

US 2005/0155510 A1 Jul. 21, 2005

(51) Int. Cl.
*F42B 7/00* (2006.01)
*F42B 12/00* (2006.01)
*F42B 30/00* (2006.01)

(52) U.S. Cl. ..... 102/502; 102/439; 102/438; 473/614

(58) Field of Classification Search ..... 102/502, 102/444, 439, 400, 448, 449, 438, 529, 442, 102/293; 473/614, 573; 446/486, 490, 400, 446/399; 124/1, 2; 42/54, 55, 58; 119/707
See application file for complete search history.

(56) References Cited

U.S. PATENT DOCUMENTS 3,067,680 A * 12/1962 Lahr ..... 102/441
3,834,311 A 9/1974 Mawhinney et al.
3,927,881 A * 12/1975 Lemelson et al. ..... 473/573
3,938,272 A * 2/1976 Ditto et al. ..... 42/55
3,952,662 A 4/1976 Greenlees
4,823,702 A 4/1989 Woolsey
4,843,750 A * 7/1989 Blase ..... 42/95
4,962,926 A 10/1990 Chen
4,991,841 A 2/1991 Paranto
5,344,155 A * 9/1994 Huang ..... 273/348.4
5,361,700 A * 11/1994 Carbone ..... 102/439
5,450,795 A * 9/1995 Adelman ..... 102/444
5,691,501 A 11/1997 Gilbert
5,845,629 A * 12/1998 Ratliff ..... 124/56
6,295,933 B1 * 10/2001 Dubocage et al. ..... 102/439
6,302,028 B1 10/2001 Guillot-Ulmann et al.
6,527,616 B1 3/2003 Li
6,546,874 B1 * 4/2003 Vasel et al. ..... 102/444
2002/0129725 A1 * 9/2002 Bice et al. ..... 102/442

FOREIGN PATENT DOCUMENTS

EP 0 103 509 A1 * 3/1984

* cited by examiner

*Primary Examiner*—Michael J. Carone
*Assistant Examiner*—James S. Bergin
(74) *Attorney, Agent, or Firm*—Hoffman & Baron LLP

(57) ABSTRACT

A close range munition for firing from a bore of a weapon. The munition includes a spherical projectile having a central core and a plurality of uniformly radially extending resilient filaments defining an outer diameter. The outer diameter of the projectile is greater than the diameter of the firing bore so as to compress the filament within the bore.

4 Claims, 3 Drawing Sheets

EXPANDED VOLUME LESS LETHAL BALL TYPE PROJECTILE

FIELD OF THE INVENTION

The present invention relates generally to a munition designed to impact a target with low lethality. More particularly, the present invention relates to an improved less-lethal projectile of ball type design having an expandable volume.

BACKGROUND OF THE INVENTION

There is a well established need to provide a munition, having a projectile which can impact a target with a low likelihood of inflicting a lethal blow. The need for such a munition can be seen in numerous situations, such as military and police applications, self-defense and even animal control. A desirable, less-lethal shot gun munition would be able to impart a stopping or disabling force on the target.

The art includes numerous examples of various projectiles, which are designed to impact the target with a less lethal force. One type of shotgun round designed for less-lethal applications includes substituting a conventional shot gun slug with a flexible deformable sack which may contain particulate matter. The sack is designed to deform upon impact with the target, imparting a blow without significant penetration. Examples of such less-lethal rounds are shown in U.S. Pat. Nos. 6,202,562 and 6,283,037.

Other examples of less-lethal shot gun rounds include slugs manufactured from deformable materials, which deform or spread out upon impact, thereby reducing incidences of penetration upon impact. An example of such rounds is shown in U.S. Pat. Nos. 3,952,662 and 5,691,501. Additionally, other rounds include destructible slugs carrying fluid or other substances within. Recreational paint balls are an example of such destructible projectiles and which are shown, for example, in U.S. Pat. Nos. 5,254,379 and 6,546,874.

Each of the projectiles of the prior art, which are designed to be less lethal, suffer from certain disadvantages. First, the projectile or slug itself is complicated and expensive to manufacture, as compared with traditional shot gun slugs. Second, many of the known, less-lethal rounds require use of specialized non-standard weapons.

It is, therefore, desirable to provide a less-lethal munition which is easy to manufacture and provides effective, less-lethal kinetic impact at close range.

SUMMARY Of THE INVENTION

The present invention relates to a munition which may be fired from a bore of a weapon. The munition includes a spherical projectile having a core and a plurality of uniform resilient filaments radially extending from the core. The filaments define an outer diameter which is greater than the diameter of the firing bore.

The present invention additionally relates to less-lethal shot gun round. The round includes a generally tubular hull having a forward end and an opposed rearward end. A base encloses the rearward end of the hull. A propellant is contained within the base. A wad is sealably positioned in the hull adjacent to the rearward end. A ball type projectile is carried in the hull. The projectile is generally a spherical member having a central solid spherical core. A plurality of uniform resilient filaments radially extending from the spherical core. The radially extending filaments define an outer diameter. The outer diameter defined by the filaments is greater than the inner diameter of the tubular hull. When the ball type projectile is positioned in the hull, the resilient filaments are compressed therein.

In a further embodiment of the present invention, the hull may carry plurality of such projectiles.

DETAILED DESCRIPTION OF THE PREFERRED EMBODIMENTS

The present invention is directed to a less-lethal close range munition projectile. The projectile of the present invention may be fired from various weapons. The type of weapon employed dictates the type of cartridge in which the projectile is placed. For simplicity of description the projectile will be described with respect to a shot gun slug. It may be appreciated, however, that the present invention is not limited thereto.

Figure 1:
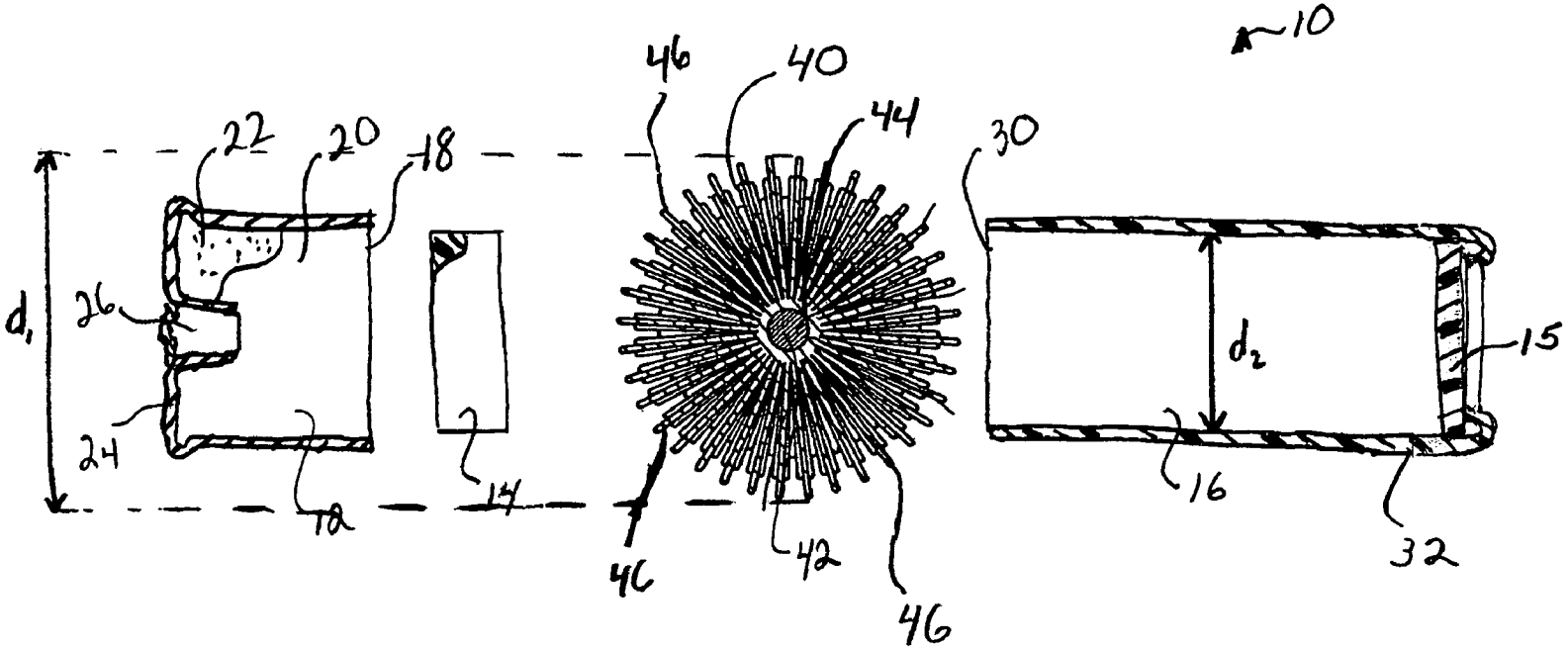
FIG. 1 is an exploded view, a partially in section, of a close range munition of the present invention in the form of a shot gun slug.

As is shown in FIG. 1, round 10 of the present invention includes a base 12, a wad 14 and a hull 16, all of generally conventional construction. Such construction is shown, for example, in U.S. Pat. No. 6,202,562, issued Mar. 20, 2001, to Brunn et al and entitled, "Methods of Preparing a Low Lethally Projectile for Flight"; and U.S. Pat. No. 6,546,874, issued Apr. 15, 2003 to Vasel et al, entitled, "Non-lethal Projectile for Delivering an Inhibiting Substance to a Living Target," incorporated herein for all purposes.

Base 12, which is generally formed of metallic material, preferably brass, is a cup shape member having an open upper end defining a base interior 20. Base interior 20 supports a propellant 22, which is generally an explosive charge. The base 12 also supports at a lower end 24 thereof a primer 26, which when struck, ignites the propellant. A wad 14 interposed between base 12 and hull 16, which sealably contains propellant 22 in compression, sealing it from the hull. As shown herein by way of example, wad 14 is a generally disk shape, plastic member. However, as is well known in the art and as is shown further hereinbelow, wad 14 may take various sizes, shapes and constructions, depending upon the application of the round. Hull 16 is an elongate, tubular member having an open end 30 adjacent base 12 and an opposed crimped, closed end 32. Hull 16 of the present invention is typically formed of a plastic material. However, as is well known in the art, other materials and constructions for hull 16 may also be employed. In accordance with the present invention, hull 16 is designed to support one or more non-lethal projectile ball-type shot gun slugs 40. A protection disk 15, also preferably formed of plastic, is interposed in hull 16 at the closed end so as to close the interior and prevent entry of contamination.

Figure 3:
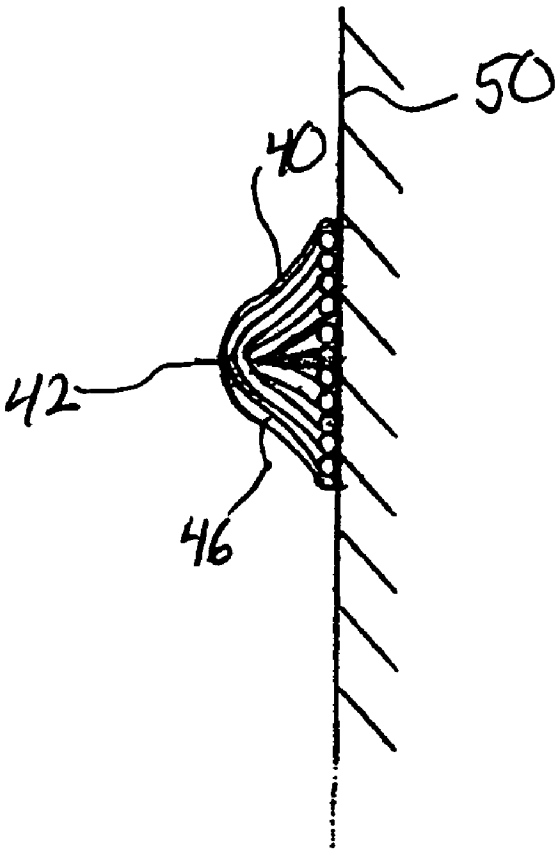
FIG. 3 is a schematic representation of the ball type projectile of the present invention upon impact with the target.
Figure 2:
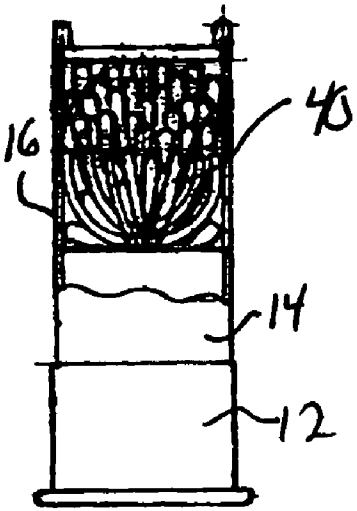
FIG. 2 shows the ball type projectile compressed within the tubular hull in position for firing.

Referring additionally to FIGS. 2 and 3, projectile slug 40 of the present invention is shown. Slug 40 is generally a ball type projectile having a spherical solid center core 42. Preferably, core 42 is a round solid relatively hard member of small diameter. Core 42 may be formed of conventional materials, including rigid plastic and metal. Integrally formed about the core is a core covering 44, which encloses the core. While a solid spherical core is shown, other shapes and constructions of the core may be employed. Preferably integrally formed with an extending radially outward from the core covering is a plurality of filaments 46. The filaments 46 radiate in all directions from the core. The filaments themselves define an outer diameter d1, which is substantially greater than the inner diameter d2 of hull 16 or the bore from which the projectile is fired. Thus in FIG. 2 as the ball type projectile 40 is placed within the hull, the filaments substantially compressed to a smaller diameter.

The ball type slug of the present invention may be of the type similar to those commonly used as a toy for throwing and catching. One such device is shown and described in U.S. Pat. No. 4,962,926, issued Oct. 16, 1990, to Chen and entitled, "Spherical Throwing And Catching Device," and which is incorporated by reference herein.

As described in the '926 patent solely for illustrative purposes, the filaments are made of a plastic material commercially named Kranton-G from American Shell. During production, a solvent is added to the material for softening. This results in large amount of floppy, slender elastic filaments which uniformly radiate from the core to form the spherical body. The filaments each have an elastic soft fine circular rod-like structure. It is contemplated that the ratio of the central core 42 to the filament length may be varied, as well as the filament stiffness.

The combination of the high density core and the filaments result in a ball-like projectile which is more accurate in flight. Moreover, the elastic soft fine circular rod-like structure provided by the filament has good shock absorbing effect. The instance that spherical slug contacts the target, the filaments absorb much of the energy. Such an arrangement is shown in FIG. 3, where the spherical projectile 40 impacts target surface 50.

On impact, those filaments facing forward and making first contact with the target act as shock absorbers by slowing impact. Those filaments radiating out and away from the line of travel will provide shock absorption by providing pliable and deformable surface area reducing the tendency and ability of the projectile to penetrate. As an example: a 1.00" diameter projectile weighing 45 grains and traveling at 650 feet per second spreads its available kinetic energy across a larger area of the target than does a 0.73" diameter projectile of the same weight at the same speed. It takes longer for the available energy of the smaller diameter projectile to dissipate its energy, resulting in deeper penetration.

Figure 2A:
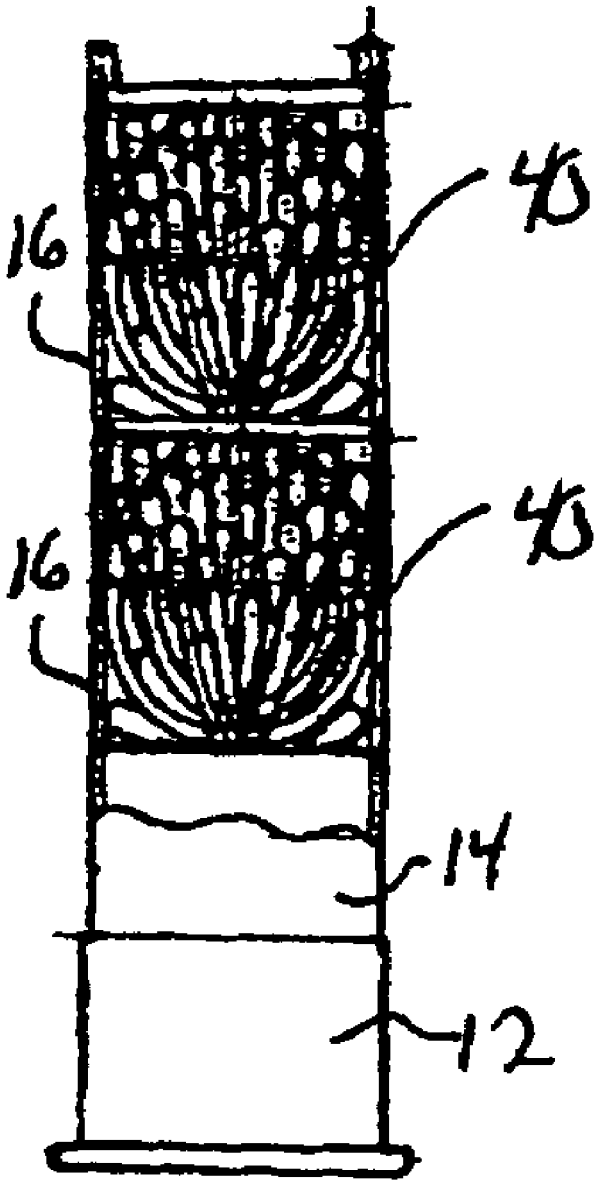
FIG. 2A shows a plurality of ball type projectiles compressed within the tubular hull in position for firing.

As shown in FIG. 2A, it is further contemplated that a plurality of spherical projectiles may be positioned within hull 16. The plurality of projectiles 40 would be arranged preferably linearly in hull 16. However, other random arrangements of the projectiles in the hull are possible. Each would have an outer diameter defined by the filaments which is greater than the inner diameter of the associated hull. Again, this results in the filaments being compressed upon insertion in the hull and re-expanded upon firing.

The present invention therefore provides close range spherical projectiles having low lethality. Such projectiles contact the target with a stopping impact, yet the energy absorbed by the filaments yields a low risk of target penetration.

What is claimed is:

1. A less-lethal shot gun round comprising:

a generally elongate tubular hull having a forward end and an opposed rearward end;

a base enclosing said rearward end of said hull;

a propellant contained within said base;

a wad sealably positioned in said hull adjacent said rearward end; and a projectile carried in said hull, said projectile being a generally spherical member having a central solid spherical core and a plurality of uniformly radially extending resilient filaments defining an outer diameter, said diameter being greater than the inner diameter of said tubular hull, said projectile being positioned in said hull such that said resilient filaments are compressed therein.

2. A less-lethal shot gun round of claim 1 wherein said projectile is integrally formed of non-metallic material.

3. A less-lethal shot gun round of claim 1 wherein said filaments are defined by uniformly fine, floppy, elastic rod like elements which uniformly radiate from said core to form therewith a hedgehog-like spherical body.

4. A less-lethal shot gun round of claim 1 wherein said hull carries a plurality of said projectiles.

* * * * *